US007240673B2

(12) United States Patent
Class et al.

(10) Patent No.: US 7,240,673 B2
(45) Date of Patent: Jul. 10, 2007

(54) FLANGE FOR FLAME OBSERVATION

(75) Inventors: Michael Class, Untersiggenthal (CH); Marcus Gall, Nussbaumen (CH)

(73) Assignee: ALSTOM Technology Ltd., Baden (CH)

( * ) Notice: Subject to any disclaimer, the term of this patent is extended or adjusted under 35 U.S.C. 154(b) by 230 days.

(21) Appl. No.: 10/998,044

(22) Filed: Nov. 29, 2004

(65) Prior Publication Data

US 2005/0115167 A1 Jun. 2, 2005

Related U.S. Application Data

(63) Continuation of application No. PCT/EP03/50179, filed on May 20, 2003.

(30) Foreign Application Priority Data

May 28, 2002 (CH) ..... 0888/02

(51) Int. Cl.
*F23M 7/00* (2006.01)

(52) U.S. Cl. ..... 126/200; 432/250; 266/100; 49/171; 52/204.593

(58) Field of Classification Search ..... 52/204.5, 52/204.6, 204.593, 210; 126/200, 198; 110/173 R; 432/250, 247; 266/100; 49/171
See application file for complete search history.

(56) References Cited

U.S. PATENT DOCUMENTS 3,154,821 A 11/1964 Weker
4,210,120 A 7/1980 Ritopecki
4,332,663 A * 6/1982 Berneke ..... 204/277
5,000,580 A 3/1991 Leininger et al.
5,748,090 A * 5/1998 Borg et al. ..... 340/578

(Continued)

FOREIGN PATENT DOCUMENTS

DE 37 36 442 5/1988

(Continued)

OTHER PUBLICATIONS

Yasutaka, M., "Sight Glass of Combustion Container," Patent Abstracts of Japan 1999; 2000(15), Publication No. 2000346348.

(Continued)

*Primary Examiner*—Jeanette Chapman
(74) *Attorney, Agent, or Firm*—Cermak & Kenealy, LLP; Adam J. Cermak

(57) ABSTRACT

A flange (1) for optical flame observation in a gas turbine includes at least one bore for optical observation, in which bore there is arranged at least one pane (9, 10) for separating the flame-side space, which is in substantially direct communication with a combustion chamber in which the at least one flame that is to be monitored is arranged, from the outside space, from which the observation of the at least one flame can take place. In a flange (1) of this type, fogging of the at least one pane (9, 10) is made possible in a simple manner which can be guaranteed over a prolonged period of time by virtue of the fact that two panes (9, 10), which delimit a sealed intermediate space (22) in the bore for optical observation, are arranged one behind the other with respect to the optical axis (8), and that a device (24) for dehumidifying the sealed intermediate space (22) is includes.

21 Claims, 1 Drawing Sheet

U.S. PATENT DOCUMENTS

| | | | | |
|---|---|---|---|---|
| 6,024,084 | A | 2/2000 | Gerhardinger | |
| 6,168,112 | B1 * | 1/2001 | Mueller et al. | 244/129.3 |

FOREIGN PATENT DOCUMENTS

| | | | |
|---|---|---|---|
| EP | 0 181 435 | | 5/1986 |
| GB | 343 580 | | 2/1931 |
| JP | 2000073667 A | * | 3/2000 |
| JP | 2000073668 A | * | 3/2000 |
| JP | 2004324268 A | * | 11/2004 |
| WO | 89/12774 | | 12/1989 |

OTHER PUBLICATIONS

Search Report for Swiss Appl. No. CH 0888/02.
International Search Report for PCT Appl. No. PCT/EP03/50179.
International Preliminary Examination Report for PCT Appl. No. PCT/EP03/50179.

* cited by examiner

FLANGE FOR FLAME OBSERVATION

This application is a Continuation of, and claims priority under 35 U.S.C. § 120 to, International Application no. PCT/EP03/50179, filed 20 May 2003, by the inventors named herein, and claims priority under 35 U.S.C. § 119 to Swiss application no. 2002 0888/02, filed 28 May 2002, the entireties of both of which are incorporated by reference herein.

BACKGROUND OF THE INVENTION

1. Field of the Invention

The present invention relates to a flange for optical flame observation in a gas turbine. The flange comprises at least one bore for optical observation, in which bore there is arranged at least one pane for separating the flame-side space, which is in substantially direct communication with a combustion chamber in which the at least one flame that is to be monitored is arranged, from the outside space, from which the observation of the at least one flame can take place.

2. Brief Description of the Related Art

For safety reasons, the flames in the combustion chamber of a gas turbine have to be observed and monitored. Inter alia in the case of annular combustion chambers, in which to a certain extent there is a single, encircling flame supplied by a plurality of burners arranged over the circumference of the circle, this monitoring and observation is carried out, for example, by at least one observation tube being passed through the housing of the gas turbine to the outer side of the gas turbine. The tube leads through cavities which are arranged in the housing and are used, for example, to supply cooling air, additional combustion air or to accommodate fuel supply lines, etc. The tube is usually open toward the combustion chamber, i.e. the pressure prevailing in the tube usually substantially corresponds to the pressure in the combustion chamber, and the temperature in the tube is likewise usually in the region of the temperature in the combustion chamber, although on account of weak convection in the tube a decreasing gradient is established toward the outer side of the gas turbine with respect to the temperature.

Observation means in the form of flame monitors with optical detectors, which allow automated and continuous observation and monitoring of the flame activity, are usually arranged on the outer side of the gas turbine. These observation means are arranged outside the gas turbine, i.e. substantially at room temperature and standard pressure, on the one hand in order not to apply excessive thermal and mechanical loads to these observation means, and on the other hand to make them easier to exchange and easier to carry out maintenance work on. In order accordingly to seal the tube with respect to the outer side, where substantially room temperature and standard pressure prevail, without at the same time impairing the optical path for observation, it is customary to provide at least one suitable pane, i.e. a pane which does not interfere with the optical path of flame observation, which pane is fitted either at the end of the observation tube or in a flange placed onto the observation tube. On account of the high temperature differences and pressure differences between the interior of the observation tube and the surroundings of the gas turbine, this pane has to satisfy high mechanical demands and has to be well sealed. For this purpose, it is customary for the at least one pane to be fitted into the flange, i.e. for example welded into the flange.

SUMMARY OF THE INVENTION

Accordingly, one aspect of the present invention includes providing a flange having at least one inserted pane which, for example, allows the observation of flames in the combustion chamber of a gas turbine. This is a flange for optical flame observation, comprising at least one bore for optical observation, in which bore there is arranged at least one pane for separating the flame-side space, which is in substantially direct communication with a combustion chamber in which the at least one flame that is to be monitored is arranged, from the outside space, from which the observation of the at least one flame can take place.

An exemplary flange in accordance with principles of the present invention is distinguished by the fact that two panes, which delimit a sealed intermediate space in the bore, are arranged one behind the other with respect to the optical axis, exemplarily parallel to one another and perpendicular to the optical axis, and that means for dehumidifying the sealed intermediate space are provided. Arranging two panes one behind the other has the advantage of creating a redundant system. In other words, the presence of two panes one behind the other results in increased safety, since each pane alone is advantageously able to withstand the entire temperature difference and pressure difference between the outside environment and the interior of the observation tube. Therefore, a defect at one of the two panes does not immediately lead to failure of the gas turbine (which is inevitable if there is open connection between the combustion chamber and the outside environment), since the second pane can immediately take over the entire function of the first pane all on its own. Arranging two panes one behind the other presents problems insofar as humid air which may be enclosed in the intermediate space between the two panes has the tendency to condense on the cold pane, i.e. on the pane facing the observation means, above a certain humidity level. Fogging of this pane makes it difficult if not impossible to observe the flame using the observation means, since the optical path is significantly impeded and therefore the measurement is distorted. According to the invention, this problem is solved by the provision of means for dehumidifying the intermediate space between the two panes. This can be achieved, for example, by the application of a vacuum. However, applying a vacuum has the drawback that the intermediate space between the two panes has to be extremely well sealed, since otherwise the vacuum cannot be ensured in the long term. In addition, under the standard pressure and temperature loads when using a flange of this type at a gas turbine, complete leaktightness of the intermediate space can only be ensured with very great difficulty, and accordingly a flange with an evacuated intermediate space has to be exchanged at frequent intervals, since evacuation in situ is scarcely possible. The continuous dehumidification of this intermediate space by dehumidification means of another type therefore prove to be simpler and more expedient, since maintenance of dehumidification means of this type is significantly simpler compared to when this region is evacuated. In particular, it is not generally necessary in this case for the entire flange to be exchanged, but rather only the dehumidification means have to be exchanged.

According to a first exemplary embodiment of the present invention, the means are accordingly designed in the form of at least one drying cartridge. In this case, the drying cartridge may accordingly be arranged in the flange in a region which is in communication with the intermediate space between the two panes, so as to ensure dehumidification of this intermediate space. It is also possible for the drying cartridge to be arranged directly in the intermediate space, provided that it does not interfere with the optical path for observation. Products which can be reused for dehumidification after the uptake of moisture by simply being heated are particularly suitable for use as drying cartridges. These are usually, for example, hygroscopic substances stored in a porous aluminum container which have the property of releasing the water which they have taken up again when an elevated temperature is applied. For example, drying cartridges of this type, after the uptake of moisture, can simply be dried again by heating in a furnace and then reused for dehumidification of the intermediate space.

According to a further exemplary embodiment of the invention, the dehumidification means are arranged in such a manner in the flange that they can be inserted, exchanged and/or removed from the outer side of the flange, remote from the intermediate space. This arrangement of, for example, a drying cartridge in the flange allows these dehumidification means to be exchanged without one of the two panes positioned one behind the other having to be removed from the flange. This makes maintenance of the flange particularly simple and efficient. In this case, the procedure is preferably such that there is at least one cavity, which is arranged to the side of the intermediate space with respect to the optical axis, for the dehumidification means, which cavity is in communication with the intermediate space, this communication being ensured in particular by means of at least one opening between the cavity and the intermediate space. This arrangement allows simple accessibility from the side of the flange (substantially from the radial side with respect to the optical axis) without the optical path being disrupted by the presence of the dehumidification means. Also preferably, the accessibility to the dehumidification means is ensured by the fact that the flange has at least one hole which is arranged substantially perpendicular to the optical axis, is in communication with the intermediate space via at least one opening, provides a cavity for receiving the means and can be sealed off with respect to the outer side of the flange by means of closure means, in particular in the form of a sealing screw. The hole may have any desired cross section, but is advantageously of cylindrical configuration (in which case the diameter is particularly preferably reduced just in front of the intermediate space, so that the cartridge is held in the region with a large diameter without dropping into the intermediate space), and is provided with an internal screw thread in its region remote from the intermediate space, so that, for example, a sealing screw (if appropriate provided with sealing rings) allows simple sealing of this hole after the drying means have been inserted.

A further exemplary embodiment of the present invention is distinguished by the fact that the observation-side pane can be inserted, exchanged and/or removed from the observation-side end of the flange, and/or that the flame-side pane can be inserted, exchanged and/or removed from the flame-side end of the flange. This simple way of exchanging the panes from the respective side likewise ensures simple, low-cost maintenance of the observation flange. For example, the panes can simply be removed and replaced or cleaned in the event of fracture or in the event of them becoming dirty, respectively. In this context, it can be particularly advantageous for the mechanical configuration of the exchangeability to be identical in form from both sides, so that both the two panes and their securing means in the flange are identical, meaning that the number of different parts is minimized. The securing means used for the panes are advantageously grub screws with a central bore, i.e. at least one of the panes is held in an internal screw thread arranged in the flange from the side remote from the intermediate space by means of at least one grub screw with an external screw thread and with an axial hole. Moreover, in this context it has proven advantageous to provide second means, allowing the grub screw to be fixed with respect to its rotation in the internal screw thread. This is in order to prevent the grub screws from coming loose during operation under the vibrations which occur in gas turbines, which can cause the leaktightness of the intermediate space to decrease on account of the loosening of the pressure on the plates. It is usual for the leaktightness on the side of the panes facing the intermediate space to be ensured by sealing rings (O rings). Sealing rings may also be arranged on the side facing the grub screw, if appropriate in combination with a washer.

An exemplary embodiment of the grub screw is distinguished by the fact that it, on the side remote from the pane, has at least one bore, in particular in the form of a blind hole, which is arranged substantially parallel to and laterally offset from the optical axis, and that the flange, at the corresponding end side, has a bore, in particular in the form of a blind hole, which runs substantially parallel to the bore and is arranged axially outside the internal screw thread with respect to the optical axis, it being possible for the grub screw to be fixed by means of a securing clip which projects into the two bores. This is a simple, readily realizable embodiment of the second fixing means. The securing clip, which can easily be realized, for example, by a U-shaped wire, is in this way fixed in a simple and to a certain extent automatic way by the flange being secured to the housing and/or observation tube on the combustion chamber side and/or by the fitting of an observation means to the outer side.

Another exemplary embodiment is characterized in that the observation of the flame is carried out by means of a flame monitor with optical detector, and in that in particular the flange is attached to the housing of a gas turbine by means of a flange plate, the observation of the at least one flame in the combustion chamber of the gas turbine being carried out via an observation tube which projects through the housing of the gas turbine on the optical axis toward the combustion chamber and thereby connects the combustion chamber via the interior of the observation tube.

Another exemplary embodiment of the invention has panes made from quartz glass with a thickness in the range from 0.5 to 2 cm, in particular in the region of 1 cm, the panes having a diameter in the range from 1.5 to 4 cm, in particular in the region of 3 cm. In this case, the two panes are advantageously spaced apart from one another along the optical axis by a distance in the range from 2 to 10 cm, in particular in the range from 3 to 5 cm, and seals, in particular in the form of Teflon or graphite seals, are provided in the direction of the intermediate space and/or toward the securing means remote from the intermediate space.

BRIEF DESCRIPTION OF THE DRAWINGS

The invention is to be explained in more detail below on the basis of exemplary embodiments in conjunction with the drawing, in which.

DETAILED DESCRIPTION OF EXEMPLARY EMBODIMENTS

Figure 1:
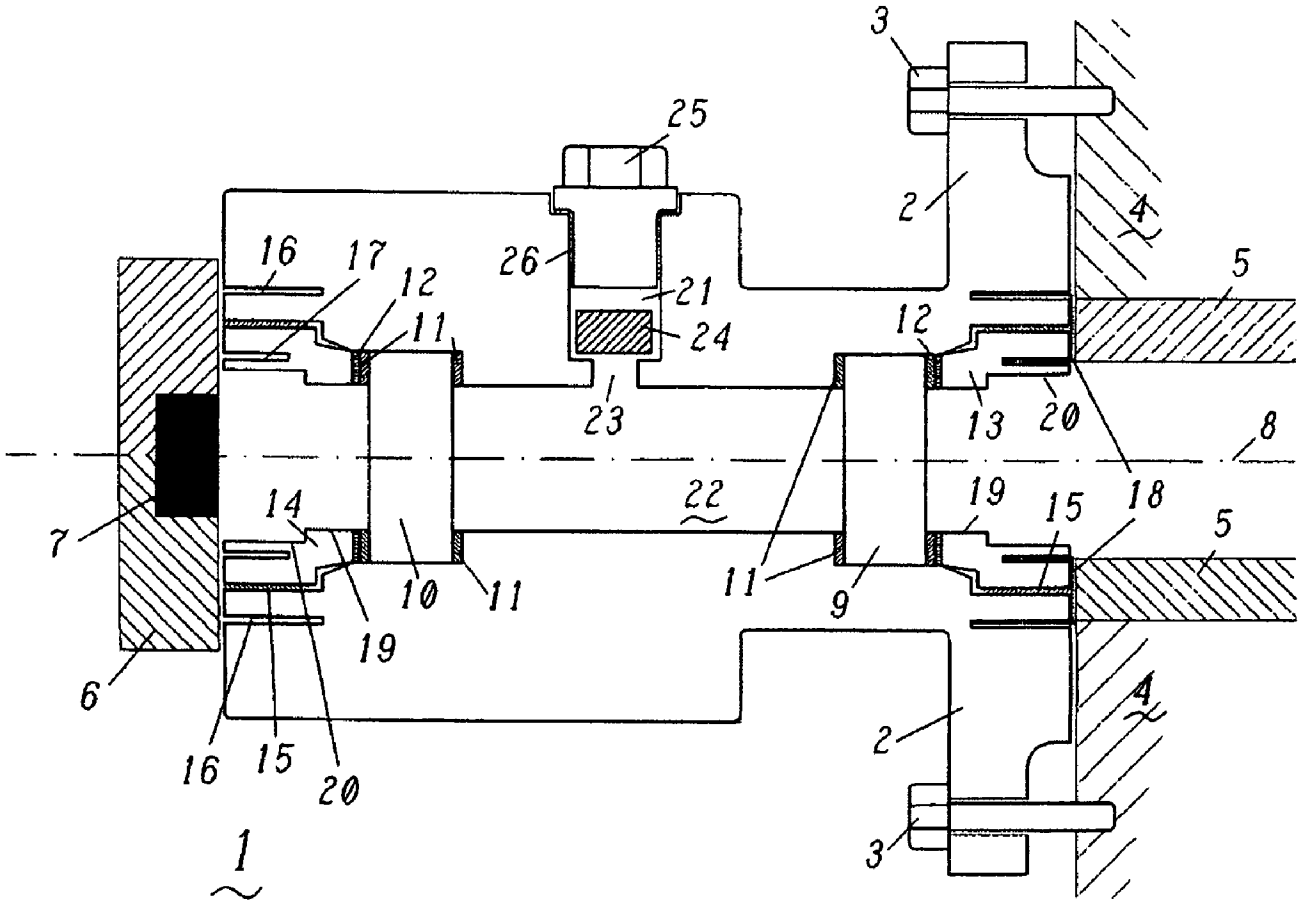
FIG. 1: shows an axial section through a flange for flame observation.

FIG. 1 shows an observation flange which is to serve as an exemplary embodiment of the present invention. The flange 1 has a flange plate 2 by means of which the observation flange can be attached to a housing 4. For this purpose, the flange plate 2 is provided with bores through which corresponding securing screws 3 can be guided and screwed to the housing 4. The flange 1 has a body which is in this case cylindrical in form, the body narrowing in a region between the part remote from the housing 4 and the flange plate 2, so that the screws 3 can be introduced and secured without problems. A flame monitor 6 which has an optical detector 7 is arranged on that side of the flange 1 which is remote from the housing 4. This optical detector 7 is directly electronically connected to the control unit of the gas turbine and is used for continuous monitoring of the flame in the combustion chamber.

In its central region, along the optical axis 8, the flange 1 has a bore which is used for observation of the flame. In this case, this bore is of cylindrical design. However, the bore may also have a rectangular or polygonal cross section. The bore is of stepped design from both sides of the flange, so that the two panes 9 and 10 can be pushed in from both sides until they come to a stop. A sealing ring 11 is arranged between the stop and panes 9 and 10, this sealing ring 11 sealing the intermediate space 22 arranged between the panes when the panes 9 and 10 are pressed onto the stop. The bore widens out toward the end of the flange on both sides following the panes 9 and 10, with an internal screw thread 15 being provided in the outermost region. A grub screw 13 or 14 with a central hole (to ensure that the optical axis is not locked) is then screwed into this outer region of the bore and serves to press the respective pane 9 or 10 onto the above-mentioned stop. First of all a further seal 11 is arranged between grub screw 13 or 14 and pane 9 or 10, respectively, and in addition a washer 12 is preferably provided between this seal 11 and grub screw 13 or 14, which washer is intended, inter alia, to prevent damage to the sealing ring 11 when the grub screw is being screwed in. The grub screw 13 or 14 is cylindrical in form in its region 19 facing the pane, whereas in the outer region 20 the internal cross section of the grub screw 13 or 14 is polygonal or of similar form, so that this nut can easily be screwed into the flange 1 from the outside using a corresponding tool which is to be inserted (for example a hexagon key). Moreover, the grub screw 13 or 14 has one or more blind holes 17, and the flange 1 has corresponding blind holes 16 at its end sides. The blind holes 16 and 17 are provided for the purpose of accommodating a securing clip 18, so that the nut can no longer be rotated with respect to the flange 1 once the securing clip 18 has been inserted. One blind hole 16 is usually sufficient for this purpose, since the large number of holes 17 in the grub screws 13 and 14 means that there is always a suitable distance for introduction of the wire 18 without disruption to the optical axis. This fixing prevents the grub screw 13 or 14 from coming loose in the screw thread 15 under the vibrations which customarily occur when gas turbines are operating, which would mean that the sealing of the panes 9 and 10 would also no longer be ensured in the long term.

This particular mechanical realization of the securing of the panes 9 and 10 in the flange now makes it possible, unlike with the welding process which is customary in the prior art, to easily exchange and/or clean the panes, since the panes can be removed from the flange and cleaned or replaced by simply loosening the grub screws. This new realization is advantageous in particular in combination with the mechanism for fixing the grub screw, which makes this flange especially suitable for use in gas turbines.

The flange 1 has an additional bore which runs substantially perpendicular to the axis 8 and which narrows in stepped form just before the intermediate space 22 to form a connecting opening 23. The cavity 21 formed in the bore is in communication with the intermediate space 22 via the opening 23. A drying cartridge 24 can be inserted into this bore from the transverse outer side of the flange, and then a sealing screw 25 can be screwed and fixed into a corresponding screw thread 26 provided in the bore, with the screw 25, together with the sealing rings, sealing off the cavity 21 with respect to the outside, optionally in a stepped arrangement.

The opening 23 has a diameter of 10 mm, and the space 21 corresponds to a ¾" thread.

The drying cartridge 24 is operatively connected to the intermediate space 22 and can therefore dehumidify this intermediate space 22. On the other hand, however, this drying cartridge 24 can also be exchanged or replaced very easily, since it is readily accessible from the outer side of the flange by simply unscrewing the sealing screw 25 (if appropriate even when the gas turbine is operating). Examples of suitable drying cartridges 24 include products of type A3 produced from Süd Chemie AG, Cologne, DE. Cartridges of this type are made from aluminum sheet, are filled with approx. 3 g of molecular sieves and can be regenerated. The uptake of moisture is effected by means of a nonwoven via a hole in the underside. Their diameter is 23 mm and their height 11 mm. The molecular sieves are synthetically produced zeolites. The uptake of water is approx. 18% by weight, irrespective of the relative humidity prevailing. The regeneration temperature is between 250 and 300 degrees Celsius (the moisture stored in drying means is released again at these temperatures). At lower temperatures, silica gel or blue gel would also be conceivable drying agents. In other words, cartridges of this type have the advantage that they can be regenerated simply by being heated, and therefore do not have to be completely replaced. If appropriate, the cartridges may additionally have a moisture indicator which can be fitted into the housing and allows inspection or monitoring of the state of the cartridge.

This design of the flange 1 has proven suitable for connection to observation tubes 5. These observation tubes 5 have a diameter which is usually at least as great as the bore in the region of the intermediate space 22, i.e. for example 3 cm. An observation tube of this type is in direct communication with the combustion chamber (the observation is usually at a distance of approximately 1 meter from the flame) and to a certain extent serves as a passage through the housing 4 of the gas turbine. The pressure conditions in the tube are substantially identical to those in the combustion chamber, i.e. pressures usually in the range of, for example, approx. 30 bar. Therefore, with an outside pressure of 1 bar, a pressure difference in the region of 29 bar prevails at the panes. Temperatures comparable to temperatures in the combustion chamber are likewise present in the observation tube. Accordingly, when the gas turbine is operating, the flange 1 is usually at an overall temperature of over 100 degrees Celsius. Consequently, the seals 11 should be made from graphite or Teflon or similar heat-resistant materials, and the panes 9 and 10 are usually formed from quartz glass with a thickness of approx. 1 cm. The panes are spaced apart from one another by approx. 3 cm and have an external diameter of approx. 3 cm. The diameter of the bore in the region of the intermediate space 22 is 2 cm. In order to ensure redundancy and completeness also with regard to observation, it is typical for three observation tubes of this type to be distributed over the circumference of the gas turbine.

LIST OF DESIGNATIONS

1 Observation flange
2 Flange plate
3 Securing screw
4 Housing of the gas turbine
5 Observation tube
6 Flame monitor
7 Optical detector
8 Optical axis/axis of rotation of the flange
9 First pane
10 Second pane
11 Sealing ring
12 Washer
13 First grub screw with central bore
14 Second grub screw with central bore
15 Screw thread of 13 or 14
16 Bore in the flange
17 Bore in the grub screw
18 Securing clip
19 Cylindrical part of 13 or 14
20 Hexagon part of 13 or 14
21 Cavity for drying cartridge
22 Intermediate space between the two panes 9 and 10
23 Connecting opening between 21 and 22
24 Drying cartridge
25 Sealing screw for drying cartridge
26 Screw thread of 25

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A flange useful for optical flame observation in a gas turbine, the flange comprising:

at least one pane;

at least one bore for optical observation, in which at least one bore the at least one pane is positioned for separating a flame-side space from an outside space, the flame-side space for being in substantially direct communication with a combustion chamber in which at least one flame that is to be monitored is located and from which the at least one flame can be observed;

said at least one pane comprising two panes which delimit a sealed intermediate space in the at least one bore, the two panes arranged spaced apart from one another and one behind the other with respect to an optical axis;

means for dehumidifying the sealed intermediate space;

wherein:

said two panes include an observation-side pane configured and arranged to be inserted, exchanged, removed, or combinations thereof, from the observation-side end of the flange;

said two panes include a flame-side pane configured and arranged to be inserted, exchanged, removed, or combinations thereof, from the flame-side end of the flange; or both;

an internal screw thread;

at least one grub screw including an external screw thread and an axial hole;

wherein at least one of the two panes is held, from the side remote from the intermediate space, in the internal screw thread by the at least one grub screw;

wherein the at least one grub screw, on a side remote from said at least one of the two panes, includes at least one bore arranged substantially parallel to and laterally offset from the optical axis; and a further bore positioned adjacent to said at least one grub screw and running substantially parallel to the at least one grub screw at least one bore and arranged axially outside the internal screw thread with respect to the optical axis.

2. The flange as claimed in claim 1, wherein the at least one bore comprises at least one blind hole.

3. The flange as claimed in claim 1, further comprising:

at least one securing clip projecting into said at least one grub screw at least bore and into said further bore, the at least one securing clip inhibiting rotation of said at least one grub screw in said internal thread.

4. The flange as claimed in claim 1, wherein said further bore comprises a blind hole.

5. A flange useful for optical flame observation in a gas turbine, the flange comprising:

at least one pane;

at least one bore for optical observation, in which at least one bore the at least one pane is positioned for separating a flame-side space from an outside space, the flame-side space for being in substantially direct communication with a combustion chamber in which at least one flame that is to be monitored is located and from which the at least one flame can be observed;

said at least one pane comprising two panes which delimit a sealed intermediate space in the at least one bore, the two panes arranged spaced apart from one another and one behind the other with respect to an optical axis;

means for dehumidifying the sealed intermediate space, the means for dehumidifying configured and arranged in the flange for insertion, exchange, removal, or combinations thereof, from an outer side of the flange remote from the intermediate space;

at least one cavity arranged to the side of the intermediate space with respect to the optical axis for receiving the means for dehumidifying, which at least one cavity is in communication with the intermediate space; and at least one opening between the cavity and the intermediate space providing said communication therebetween.

6. The flange as claimed in claim 5, wherein the means for dehumidifying comprises at least one drying cartridge.

7. The flange as claimed in claim 5, further comprising:

at least one hole arranged substantially perpendicular to the optical axis and in communication with the intermediate space via the at least one opening, the at least one hole including a cavity configured and arranged to receive the means for dehumidifying and to be sealed off from the outer side of the flange when closure means is positioned therein.

8. The flange as claimed in claim 5 wherein:

said two panes include an observation-side pane configured and arranged to be inserted, exchanged, removed, or combinations thereof from the observation-side end of the flange;

said two panes include a flame-side pane configured and arranged to be inserted, exchanged, removed, or combinations thereof from the flame-side end of the flange; or both.

9. The flange as claimed in claim 5, further comprising:

an internal screw thread;

at least one grub screw including an external screw thread and an axial hole;

wherein at least one of the two panes is held, from the side remote from the intermediate space, in the internal screw thread by the at least one grub screw.

10. The flange as claimed in claim 5, further comprising:

a flame monitor with an optical detector positioned for observing the flame.

11. The flange as claimed in claim 5, wherein the two panes comprise quartz glass having a thickness in the range from 0.5 cm to 2 cm and a diameter in the range from 1.5 cm to 4 cm;

wherein the two panes are spaced apart from one another along the optical axis by a distance in the range from 2 cm to 10 cm; and further comprising seals configured and arranged to seal the two panes in the direction of the intermediate space, in the direction away from the intermediate space, or both.

12. The flange according to claim 6, wherein the at least one drying cartridge is configured and arranged to be reused for dehumidification by heating up after uptake of moisture.

13. The flange as claimed in claim 5, wherein the two panes are arranged substantially perpendicular to the optical axis.

14. The flange as claimed in claim 7, further comprising said closure means including a sealing screw.

15. A system comprising:

a flange according to claim 10;

a gas turbine including a housing, a flange plate, a combustion chamber, and an observation tube projecting though the gas turbine housing on the optical axis toward the combustion chamber;

wherein said flange is attached to the gas turbine housing with the flange plate; and wherein the flame monitor is configured and arranged to observe the at least one flame in the gas turbine combustion chamber though the observation tube.

16. The flange as claimed in claim 11, wherein the quartz glass has a thickness of about 1 cm.

17. The flange as claimed in claim 11, wherein the quartz glass has a diameter of about 3 cm.

18. The flange as claimed in claim 11, wherein the two panes are spaced apart from one another along the optical axis by a distance in the range from 3 cm to 5 cm.

19. The flange as claimed in claim 11, wherein the seals comprise Teflon or graphite seals.

20. A system comprising:

a flange according to claim 5; and a gas turbine including a housing, a flange plate, a combustion chamber, and an observation tube projecting though the gas turbine housing on the optical axis toward the combustion chamber;

wherein said flange is attached to the gas turbine housing with the flange plate.

21. A flange useful for optical flame observation in a gas turbine, the flange comprising:

at least one pane;

at least one bore for optical observation, in which at least one bore the at least one pane is positioned for separating a flame-side space from an outside space, the flame-side space for being in substantially direct communication with a combustion chamber in which at least one flame that is to be monitored is located and from which the at least one flame can be observed;

said at least one pane comprising two panes which delimit a sealed intermediate space in the at least one bore, the two panes arranged spaced apart from one another and one behind the other with respect to an optical axis; and means for dehumidifying the sealed intermediate space; wherein:

said two panes include an observation-side pane configured and arranged to be inserted, exchanged, removed, or combinations thereof, from the observation-side end of the flange;

said two panes include a flame-side pane configured and arranged to be inserted, exchanged, removed, or combinations thereof, from the flame-side end of the flange; or both;

an internal screw thread;

at least one grub screw including an external screw thread and an axial hole;

wherein at least one of the two panes is held, from the side remote from the intermediate space, in the internal screw thread by the at least one grub screw; and means for rotationally fixing the at least one grub screw in the internal screw thread.

* * * * *